US005208211A

United States Patent [19]

Kurotori et al.

[11] Patent Number: 5,208,211

[45] Date of Patent: May 4, 1993

[54] IMAGE-RECEIVING SHEET FOR ELECTROPHOTOGRAPHY AND ELECTROPHOTOGRAPHIC METHOD USING THE SAME

[75] Inventors: Tsuneo Kurotori, Tokyo; Itsuo Ikeda, Sagamihara; Manabu Mochizuki; Yuji Sawai, both of Yokohama, all of Japan

[73] Assignee: Ricoh Company, Ltd., Tokyo, Japan

[21] Appl. No.: 737,648

[22] Filed: Jul. 30, 1991

[30] Foreign Application Priority Data

Jul. 30, 1990 [JP] Japan ..... 2-201873
Aug. 31, 1990 [JP] Japan ..... 2-231456
Feb. 15, 1991 [JP] Japan ..... 3-42314

[51] Int. Cl.[5] ..... B41M 5/035

[52] U.S. Cl. ..... 503/227; 428/913; 430/126

[58] Field of Search ..... 430/66, 67, 126; 503/227; 428/195, 913

[56] References Cited

U.S. PATENT DOCUMENTS 4,992,413 2/1991 Egashira et al. ..... 503/227
4,992,414 2/1991 Kishida et al. ..... 503/227
5,071,823 12/1991 Matsushita et al. ..... 430/138

*Primary Examiner*—John Goodrow
*Attorney, Agent, or Firm*—Oblon, Spivak, McClelland, Maier & Neustadt

[57] ABSTRACT

An image-receiving sheet for use with an electrophotographic method, including a transparent support and an overcoat layer formed thereon is disclosed, in which the overcoat layer (i) includes a thermoplastic resin which has a fluidification initiation temperature lower than that of a toner for image formation to be employed or that of a resin for use in said toner, and (ii) is white and opaque from being in a porous state. Furthermore, an electrophotographic method using the above image-receiving sheet is also disclosed.

13 Claims, 4 Drawing Sheets

IMAGE-RECEIVING SHEET FOR ELECTROPHOTOGRAPHY AND ELECTROPHOTOGRAPHIC METHOD USING THE SAME

BACKGROUND OF THE INVENTION

1. Field of the Invention

The present invention relates to an image-receiving sheet for use in an electrophotographic process, and more particularly to a transparent film for use with an overhead projector (OHP), capable of producing high quality images thereon when image formation is carried out by an electrophotographic method, particularly by a multi-color electrophotographic method. The present invention also relates to an electrophotographic method using this image-receiving sheet.

2. Discussion of Background

At the image-fixing step in a series of electrophotographic processes, a toner image transferred to an image-receiving sheet is melted and deformed upon application of thermal energy from an image-fixing unit. The toner image deposited on the image-receiving sheet is thus firmly fixed thereon.

To smoothly and uniformly fix the melted toner image onto the image-receiving sheet, there is conventionally proposed a method of coating the surface of an image-receiving sheet with a resin layer with the same formulation as that of the resin for use in a toner employed.

To accomplish high quality image formation by the electrophotographic method, particularly by the multicolor electrophotographic method, it is necessary to impart high surface glossiness to the toner image formed on the image-receiving sheet or transparent film for the overhead projector (hereinafter referred to as the OHP film). For this purpose, toner particles by which a toner image is formed are required to be uniformly melted upon application of a sufficient amount of thermal energy thereto at the image fixing step.

Further, in the case of the OHP film, it is necessary to prevent light from being scattered at the boundaries of toner particles in the toner layer and being irregularly reflected at the surface of the toner layer in order to improve the color light transmission properties of the employed OHP film.

To perform the image fixing operation at a relatively low image-fixing temperature with the above-mentioned requirements taken into consideration, a resin for the toner having a low softening point is employed. As a result, a line image tends to become thick, and the sharpness and resolution of the obtained images are degraded as a whole. In addition, the hot off-set phenomenon and the spent carrier problem are readily induced.

On the contrary, when a resin having a high softening point is used for the toner, not only extremely high thermal energy is required to uniformly melt the toner particles, but also the image-receiving sheet and the OHP film are easily deformed because thermal energy is excessively applied thereto. In particular, thermal deformation of the OHP film becomes a serious problem.

SUMMARY OF THE INVENTION

Accordingly, an object of the present invention is to provide an image-receiving sheet, especially, an OHP film with excellent color light transmission properties, capable of producing high quality images thereon with excellent color reproduction when image formation is carried out by an electrophotographic method using a toner which comprises a resin having a relatively high softening point.

Another object of the present invention is to provide an electrophotographic method, in particular, a multicolor electrophotographic method capable of yielding high quality images on the above-mentioned image-receiving sheet and OHP film, using the conventional image-fixing unit, without using a special means and high thermal energy.

The above-mentioned first object of the present invention can be attained by an image-receiving sheet for use with an electrophotographic method, comprising a transparent support and an overcoat layer formed thereon, the overcoat layer (i) comprising a thermoplastic resin which has a fluidification initiation temperature lower than that of a toner for image formation to be employed or that of a resin contained in the toner, and (ii) being white and opaque from being in a porous state.

The above object can also be achieved by an image-receiving sheet comprising a transparent support and an overcoat layer formed on the transparent support, the overcoat layer (i) comprising a thermoplastic resin having a viscoelasticity different from that of a toner to be used for image formation or that of a resin contained in the toner, and (ii) being white and opaque from being in a porous state.

The above object can also be achieved by an image-receiving sheet comprising a support; an overcoat layer formed on the support, the overcoat layer comprising a thermoplastic resin which has a fluidification initiation temperature lower than that of a toner for image formation to be employed or that of a resin contained in the toner; and a top layer on the overcoat layer, which comprises a thermoplastic resin with an abrasion resistance higher than the abrasion resistance of the overcoat layer, and has a fluidification initiation temperature which is higher than that of the resin in the overcoat layer and the same as or lower than that of the toner or that of the resin contained in the toner.

The second object of the present invention can be attained by an electrophotographic method comprising the steps of (1) transferring a toner image to an image-receiving sheet comprising a transparent support and an overcoat layer formed thereon, the overcoat layer (i) comprising a thermoplastic resin which has a fluidification initiation temperature lower than that of a toner for image formation to be employed or that of a resin contained in the toner, and (ii) being white and opaque from being in a porous state; and (2) fixing the toner image on the above image-receiving sheet by using a heat-application roller at a temperature at which the resin for use in the overcoat layer of the image-receiving sheet can be fluidified.

The second object can also be achieved by an electrophotographic method comprising the steps of (1) transferring a toner image to an image-receiving sheet comprising a transparent support and an overcoat layer formed on the transparent support, the overcoat layer (i) comprising a thermoplastic resin having a viscoelasticity different from that of a toner to be used for image formation or that of a resin contained in the toner, and (ii) being white and opaque from being in a porous state; and (ii) fixing the toner image on the above image-receiving sheet by using a heat-application roller at a temperature at which the resin for use in the overcoat layer of the image-receiving sheet can be fluidified.

The second object can also be achieved by an electrophotographic method comprising the steps of (1) transferring a toner image to an image-receiving sheet comprising a support; an overcoat layer formed on the support, the overcoat layer comprising a thermoplastic resin which has a fluidification initiation temperature lower than that of a toner for image formation to be employed or that of a resin contained in the toner; and a top layer on the overcoat layer, which comprises a thermoplastic resin with an abrasion resistance higher than the abrasion resistance of the overcoat layer, and has a fluidification initiation temperature which is higher than that of the resin in the overcoat layer and the same as or lower than that of the toner or that of the resin contained in the toner; and (ii) fixing the toner image on the above image-receiving sheet by using a heat-application roller at a temperature at which the resin for use in the overcoat layer of the image-receiving sheet can be fluidified.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
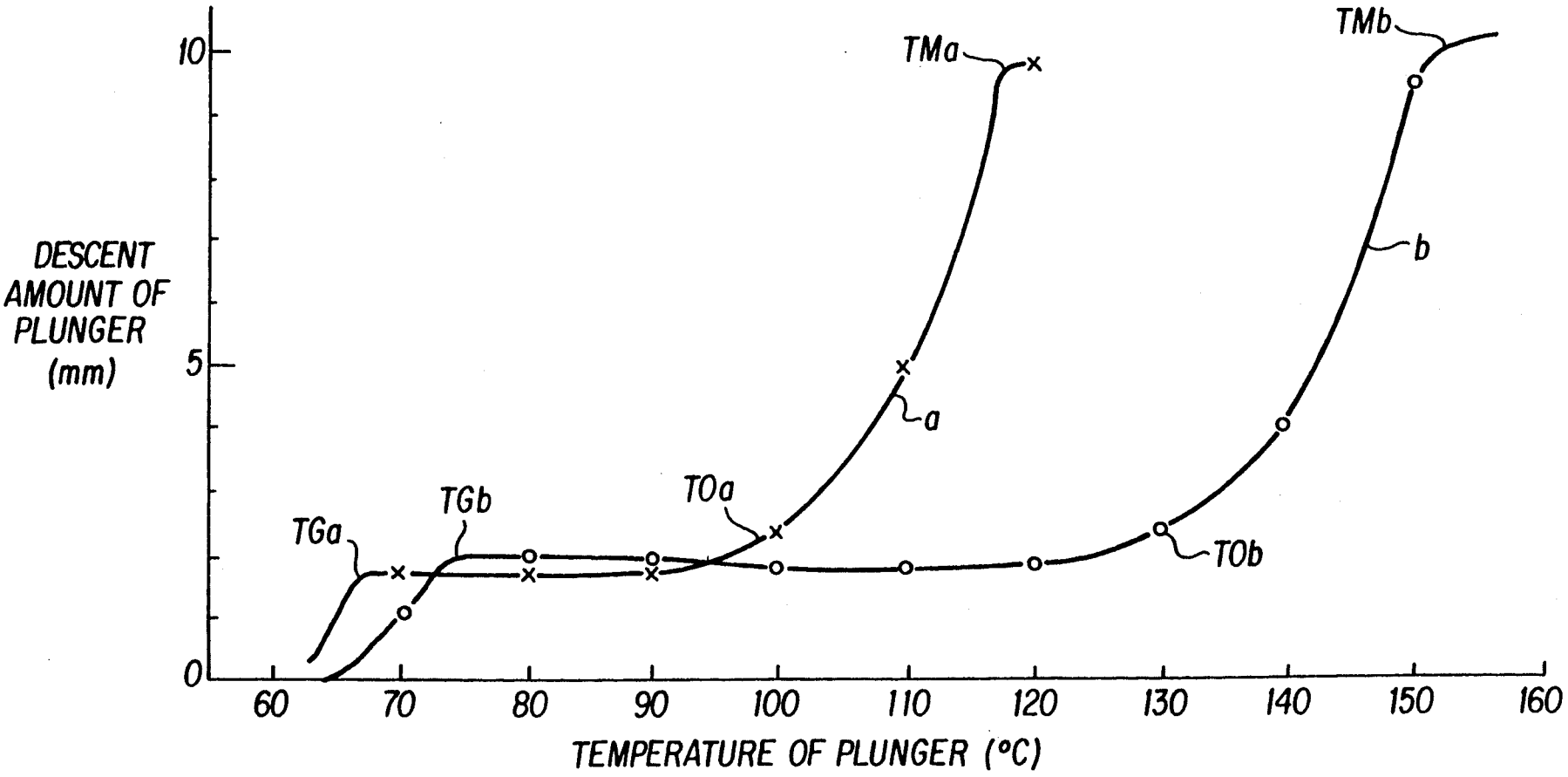
FIG. 1 is a graph showing the relationship between the thermal properties of a resin for use in the toner and the thermal properties of a resin for use in an overcoat layer of an image-receiving sheet according to the present invention.

The color reproduction and image quality of images produced by the multi-color electrophotographic method are determined by the configuration of toner particles in a toner layer formed on an image-receiving sheet after an image-fixing step, that is, the surface glossiness of the toner layer, as well as by the color properties of the employed toner. Namely, when the toner layer formed on the image-receiving sheet lacks the surface glossiness, the achromatic light which is irregularly reflected by the surface of the toner layer prevents the faithful color reproduction and decreases the maximum image density of the images.

Further, in the case of the OHP film, when the surface glossiness of the obtained toner image is insufficient, the color light transmission properties are decreased because of not only the irregular reflection of light at the surfaces of the toner layer, but also the light scattering inside the toner layer, which considerably impairs the color reproduction of the projected images.

The inventors of the present invention have studied the configuration of toner particles in the toner image on the image-receiving sheet and succeeded in upgrading the image quality and obtaining the reliability of reproduced images by improvement of the image-receiving sheet to be employed.

The image-receiving sheet for use with an electrophotographic method according to the present invention comprises a support and an overcoat layer formed thereon, which overcoat layer comprises a thermoplastic resin which has a fluidification initiation temperature at which the thermoplastic resin is fluidified, and which is lower than that of a toner for image formation to be employed or that of a resin for use in said toner, and the overcoat layer is white and opaque from being in a porous state.

The above-mentioned image-receiving sheet can be prepared by forming on at least one side of a support, for example, on a transparent film, an overcoat layer comprising a resin whose fluidification initiation temperature measured by a flow tester is lower than that of a toner or a resin contained in the toner.

The resin for use in the overcoat layer of the image-receiving sheet according to the present invention is required to be thermoplastic. For instance, homopolymers and copolymers of styrene and styrene derivatives such as p-chlorostyrene and vinyltoluene; copolymers of styrene and acrylic esters, such as styrene - methyl acrylate copolymer, styrene - ethyl acrylate copolymer, styrene - n-butyl acrylate copolymer and styrene - hexyl acrylate copolymer; copolymers of styrene and methacrylic esters, such as styrene - methyl methacrylate copolymer, styrene - ethyl methacrylate copolymer, styrene - n-butyl methacrylate copolymer and styrene - hexyl methacrylate copolymer; copolymers of styrene, acrylic ester and methacrylic ester; copolymers of styrene and a vinyl monomer, such as styrene - acrylonitrile copolymer, styrene - butadiene copolymer, styrene - vinylmethyl ketone copolymer, styrene - maleic acid ester copolymer and styrene - acrylonitrile - indene copolymer; polymethyl methacrylate; polybutyl methacrylate; polyvinyl acetate; polyester; polyamide; epoxy resin; polyvinyl butyral; polyacrylic acid; phenolic resin; aliphatic hydrocarbon resin; alicyclic hydrocarbon resin; petroleum resin; low-molecular-weight polyethylene; copolymers of ethylene and acrylic esters; and saturated polyester copolymers can be employed in the present invention.

The fluidification initiation temperature of the above thermoplastic resins for use in the present invention is lower than that of the toner or the resin contained in the toner, preferably by 5° C. or more when measured by a flow tester.

To form a porous overcoat layer comprising the aforementioned resin on the support of the image-receiving sheet, a blowing agent is dispersed or dissolved in a resin solution prepared by dissolving the above-mentioned resins into an appropriate organic solvent such as dimethylformamide, methyl ethyl ketone or tetrahydrofuran, and the resultant resin solution may be coated on the support.

The blowing agent may be caused to expand under application of heat thereto in the course of the coating operation or after the coating operation. Alternatively, the above-mentioned resin solution without such a blowing agent is coated on the support and the support having a coated resin layer thereon may be dipped into a coagulation liquid such as water to carry out the wet-type coagulation. Subsequently, the coagulated resin layer on the support is dipped into hot water of 70° C. or more to extract a solvent from the coagulated resin solution. The method for making the surface of the overcoat layer porous is not limited to the above.

It is preferable that the thickness of the overcoat layer of the image-receiving sheet be in the range of about 3 to 30 μm, and more preferably in the range of about 5 to 10 μm.

The relationship between the thermal properties of the thermoplastic resin for use in the toner and those of the thermoplastic resin for use in the overcoat layer of the image-receiving sheet according to the present invention will now be explained with reference to the graph shown in FIG. 1.

The finely-divided particles of a resin (a) for use in the overcoat layer of the image-receiving sheet and those of a resin (b) for use in the toner with a predetermined weight are separately turned into solid resin samples by pressure molding, the diameter of which samples is adjusted to the same as the inner diameter of a cylindrical container of a flow tester.

The solid resin samples (a) and (b) are separately placed in the cylindrical container of the flow tester in a heating system, which container has a lid with minute holes at the bottom. A plunger (piston) is set on each solid resin sample with a predetermined load applied thereto and the temperature of the plunger is constantly increased. As a result, the curves of the thermal properties of the resin samples (a) and (b) as shown in FIG. 1 can be obtained, by measuring the descent amount of the plunger at the respective temperatures of the plunger.

In FIG. 1, the first point of inflection, TGa or TGb, indicates the glass transition temperature at which each thermoplastic resin changes from a solid state to an amorphous state, or the second-order transition point (equivalent to Vicat softening point defined in JIS K 720).

The second point of inflection, TOa or TOb, indicates the fluidification initiation point where each thermoplastic resin is softened and starts to flow through the minute holes of the container. From the point TG to the point TO, although each resin is in an amorphous state, it shows a viscoelastic behavior just like a rubber and never flows through the minute holes of the container.

When the temperature is further increased, each thermoplastic resin sample reaches the third point of inflection, TMa or TMb. This point represents the melting point of each resin, and the resin sample is completely melted and flows.

The thermal properties of the thermoplastic resin for use in the toner and those of the thermoplastic resin for use in the overcoat layer of the image-receiving sheet according to the present invention are such as shown in FIG. 1.

In a general monochromatic (black and white) copying, the image-fixing conditions such as the surface temperature of an image-fixing heat application roller, the pressure applied by a pressure application roller and the linear speed of the rollers are controlled so as to allow the temperature of the toner to fall within the vicinity of the fluidification initiation point of the resin for use in the toner composition. In this case, the toner is hardly affected by the thermal and pressure energy at a temperature in the vicinity of the fluidification initiation point of the resin contained in the toner composition, so that it almost retains its original form.

When the above-mentioned image-fixing conditions are adapted to a multi-color electrophotographic method, color image formation cannot be satisfactorily achieved. In the conventional multi-color electrophotographic method, therefore, the image-fixing conditions are set so as to allow the temperature of the toner to fall within the vicinity of the melting point of the resin contained in the toner. In this case, however, a large quantity of thermal energy is required for the image fixing and the image-receiving sheet is easily deformed, as previously mentioned.

In the electrophotographic method of the present invention, for instance, the thermoplastic resin (b) which shows the characteristic curve of TGb - TOb - TMb, as shown in FIG. 1 is used as the resin for the toner, and the thermoplastic resin (a), which shows the characteristic curve of TGa - TOa - TMa, is used as the resin for the overcoat layer of the image-receiving sheet. Preferably, the temperature TOa is lower than the temperature TOb by 5° C. or more. In such a case, the color reproduction is improved, and the color light transmission properties of the image-receiving sheet such as an OHP film are increased even when the toner image is fixed on the image-receiving sheet at a temperature in the vicinity of, or lower than the temperature of TOb.

According to the electrophotographic method of the present invention, a toner image is transferred to the overcoat layer of the above-mentioned image-receiving sheet and fixed thereon at the fluidification initiation temperature of the resin for use in the overcoat layer.

Figure 2:
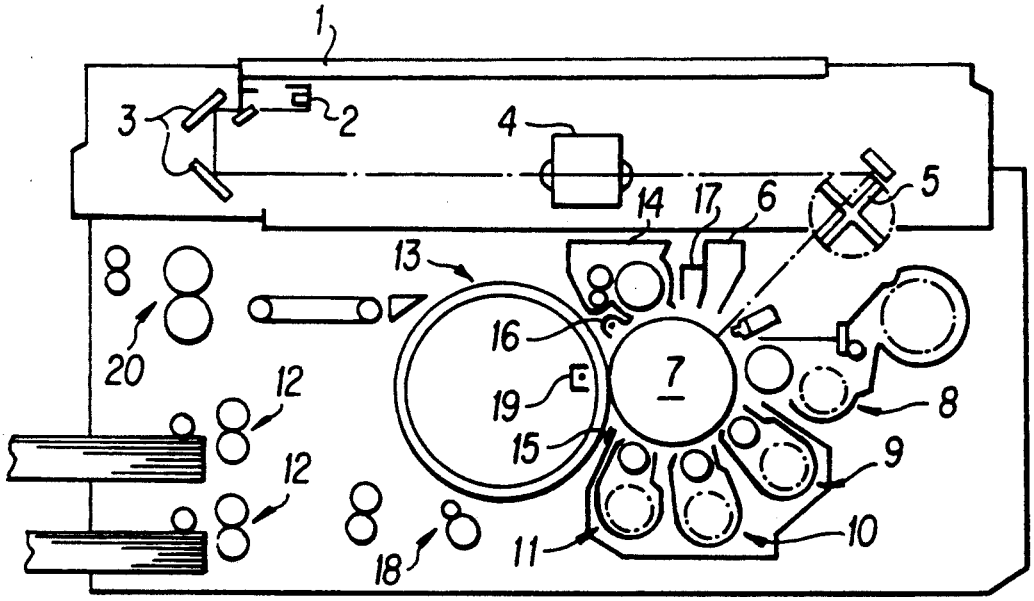
FIG. 2 is a schematic cross-sectional view of an example of a multi-color electrophotographic copying apparatus for use with the electrophotographic method according to the present invention.

Furthermore, this electrophotographic method of the present invention can be achieved by using a conventional electrophotographic copying apparatus as shown in FIG. 2.

The process of the electrophotographic method of the present invention will now be explained in detail by referring to FIG. 2.

In FIG. 2, an original (not shown) placed on a contact glass 1 is scanned by a lighting unit 2. The light reflected by the original is passed through a scanning mirror 3 and a lens 4 and subjected to color separation by a color separation filter 5. The light which has been subjected to the color separation is applied to a photoconductive drum 7 which has already been charged by a corona charger 6 employing the scorotron method, so that latent electrostatic images are formed on the surface of the photoconductive drum 7.

Around the photoconductive drum 7, there are disposed a black development unit 8, a yellow development unit 9, a magenta development unit 10 and a cyan development unit 11. When the light having a blue component which is separated by a blue color filter is applied to the photoconductive drum 7 to form a latent electrostatic image thereon, the latent electrostatic image is developed in the yellow development unit 9 by a yellow developer, the color of which is an additive complementary color of blue color. In the case where the latent electrostatic image is formed by application of the light having a green component to the photoconductive drum 7, it is developed in the magenta development unit 10 by using a magenta developer, the color of which is an additive complementary color of green color. In the case where the latent electrostatic image is formed by application of the light having a red component to the photoconductive drum 7, it is developed in the cyan development unit 11 by using a cyan developer, the color of which is an additive complementary color of red color. In such a development operation, color toner images can be formed on the photoconductive drum 7.

A transfer drum 13, which is made of a dielectric film, is disposed in contact with the photoconductive drum 7. There is provided a pre-image transfer exposure unit 15 between the cyan development unit 11 and the transfer drum 13, which exposure unit 15 has a function of decreasing the residual potential of the latent electrostatic images in order to facilitate the image transfer. An image-receiving sheet sent from paper feeding units 12 is transported to the transfer drum 13 synchronously with the movement of the transfer drum 13 by using resist rollers 18, and is fitted on a clamper of the transfer drum 13, so that the image-receiving sheet is moved to a predetermined position for image transfer. The color toner images formed on the photoconductive drum 7 are transferred to the image-receiving sheet by the aid of a transfer charger 19 while the image-receiving sheet is caused to pass between the photoconductive drum 7 and the transfer drum 13. The image-receiving sheet is then brought into close contact with the transfer drum 13. In the case of a full-color copy, the image-receiving sheet in close contact with the transfer drum 13 is rotated three or four times for overlapping a plurality of color developers. After the image-transfer operation, the image-receiving sheet is released from the clamper of the transfer drum 13 and separated from the transfer drum 13. Thereafter, it is transported to an image-fixing unit 20, where the color toner images are firmly fixed on the image-receiving sheet.

The photoconductive drum 7 which bears a residual toner which has not transferred to the image-receiving sheet is uniformly charged by a pre-cleaning charger 16 and such a residual toner is removed from the photoconductive drum 7 by using a magnet brush attached on a cleaning sleeve in a cleaning unit 14. The residual potential on the photoconductive drum 7 is completely cleared by a quencher 17, to be ready for the next image formation process.

According to the electrophotographic method of the present invention, the toner image is transferred to the aforementioned image-receiving sheet of the present invention and fixed thereon at a relatively low image-fixing temperature as compared with the conventional electrophotographic copying method in such a conventional copying apparatus as shown in FIG. 2.

At the image-fixing step of the above-mentioned electrophotographic method, the toner image may be fixed on the image-receiving sheet of the present invention by using heat- and pressure-application rollers as conventionally known. Alternatively, the toner image may be fixed on the overcoat layer of the image-receiving sheet of the present invention under an atmosphere of a temperature at which the resin for the overcoat layer is capable of fluidizing, without bringing a heated member into contact with the toner image and applying any pressure thereto.

Figure 3:
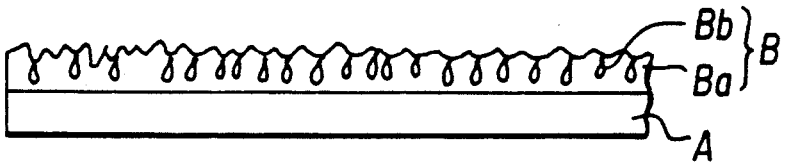
FIGS. 3 to 5 are schematic cross-sectional views of one embodiment of the image-receiving sheet of the present invention, in explanation of the process of transferring and image-fixing of color toner particles to the image-receiving sheet.
Figure 4:
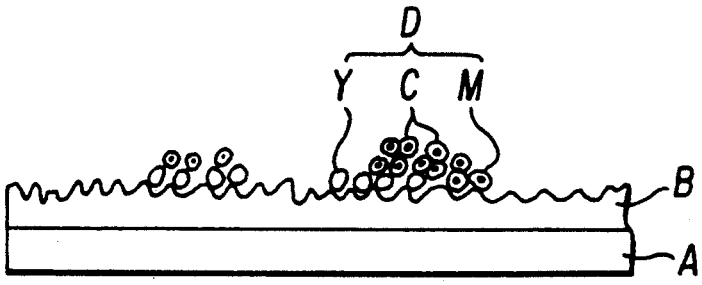
Figure 5:
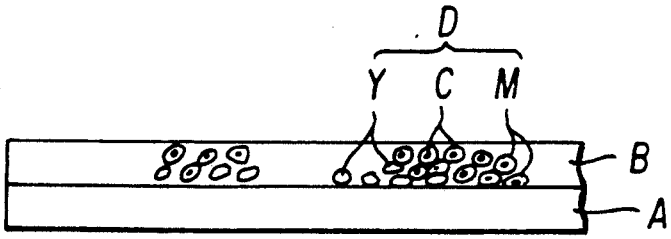

In the case where the image-receiving sheet of the present invention, which comprises a support and a porous overcoat layer formed thereon, is employed for the above-mentioned color electrophotographic method, the toner image is transferred to the image-receiving sheet and fixed thereon as shown in FIGS. 3 to 5.

In an image-receiving sheet as shown in FIG. 3, a porous overcoat layer B is formed on a support A. The porous overcoat layer B comprises a resin, the fluidification initiation temperature of which is lower than that of a toner component or a resin contained in a toner composition when measured by a flow tester. The porous overcoat layer B is white and opaque from being in a porous state, with minute pores, apertures and voids as indicated by Ba and Bb in FIG. 3.

When the color toner image is transferred to the image-receiving sheet as shown in FIG. 3 using by the conventional electrophotographic color copying apparatus as shown in FIG. 2, a color image D is transferred to the porous overcoat layer B of the image-receiving sheet as shown in FIG. 4. In the color image D, magenta toner particles (M), yellow toner particles (Y) and cyan toner particles (C) are accumulated in accordance with the color to be produced. In such a state as shown in FIG. 4, the light is irregularly reflected by the surfaces of the utmost toner layer and only the respective toner colors which are tinged with white are recognized, and the reproduced color by color mixture is never recognized even though the color toner particles are accumulated.

In FIG. 5, the transferred color toner image is fixed on the image-receiving sheet by the electrophotographic method of the present invention. When the temperature is increased in the image-fixing unit, the resin contained in the porous overcoat layer B first starts to be fluidified and the pores and voids Ba and Bb are filled up. At the same time, the toner particles on the minute gaps of the porous overcoat layer B gradually permeate through the overcoat layer B by the action of capillarity. When the image-fixing is achieved by using a heat-application roller and a pressure-application roller, the color image D is deformed somewhat because heat and pressure are applied thereto, but the color image D is embedded in the overcoat layer B as almost retaining its original form while the overcoat layer is fluidified. Thus, the toner particles constituting the color toner image D are uniformly incorporated into the overcoat layer B, so that the overcoat layer B becomes transparent with sufficient color light transmission properties, which overcoat layer B bears a color image area with excellent color reproduction.

The image-receiving sheet of the present invention may preferably comprise (a) a support, (b) an overcoat layer formed thereon, which overcoat layer comprises a thermoplastic resin having a fluidification initiation point at which it starts to assume a fluid state, which is lower than the fluidification initiation point of a toner for image formation or a resin contained in the toner to be employed for image formation, and (c) a top layer comprising a resin with a high abrasion resistance whose fluidification initiation temperature is higher than that of the resin contained in the overcoat layer and the same as or lower than that of the resin contained in the toner component to be employed for image formation. In the image-receiving sheet with such a configuration, the same support and the same resin for the overcoat layer as employed in the above can be used and the overcoat layer can be formed on the support by the same method as in the above.

To prepare the resin with a high abrasion resistance for use in the top layer of the above image-receiving sheet, the high abrasion resistance may be imparted to a resin with the same constitutional unit as that of the resin for use in the overcoat layer by increasing the molecular weight and causing the employed resin to crosslink by use of a catalyst. Alternatively, the top layer may comprise a rigid resin whose solubility parameter approximates that of the thermoplastic resin for use in the overcoat layer.

The top layer can be prepared on the above-mentioned overcoat layer formed on the support by the conventional coating method. The top layer may preferably be made white and opaque from being in a porous state, with minute pores, apertures and voids by the same method as used in the formation of the porous overcoat layer. It is preferable that the thickness of the top layer be in the range of 3 to 30 μm, and more preferably in the range of 5 to 20 μm. In other words, the thickness of the top layer is preferably 0.2 to 1 times the particle diameter of the employed toner.

In the case where the above-mentioned image-receiving sheet comprising the top layer is employed, the electrophotographic method according to the present invention also comprises the steps of transferring the toner image to the image-receiving sheet and fixing it thereon at a temperature where the resin contained in the overcoat layer starts to fluidified. This electrophotographic method can be achieved in the conventional color copying apparatus as shown in FIG. 2.

Figure 6:
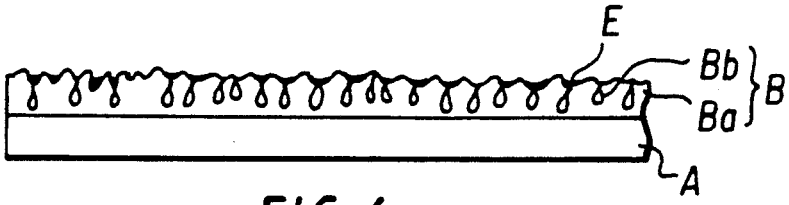
FIGS. 6 to 8 are schematic cross-sectional views of another embodiment of the image-receiving sheet of the present invention, in explanation of the process of transferring and image-fixing of color toner particles to the image-receiving sheet.
Figure 7:
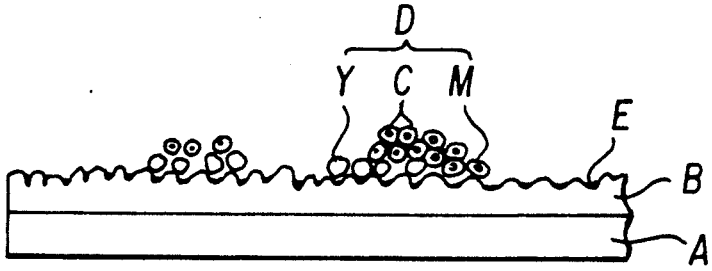
Figure 8:
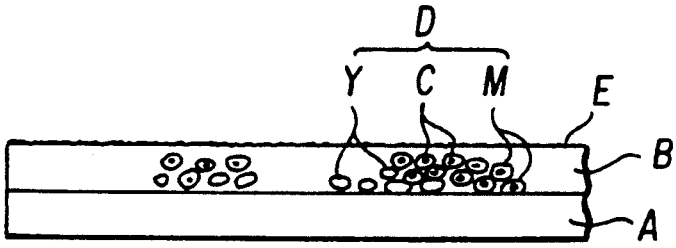

FIGS. 6 to 8 show the image-transferring and image-fixing processes of a toner image in the case where the image-receiving sheet according to the present invention comprising a support A, a porous overcoat layer B and a porous top layer E is used. In FIG. 6, the porous overcoat layer B, which is white and opaque and has minute pores, apertures and voids Ba and Bb on the surface, comprises a resin whose fluidification initiation temperature is lower than that of the toner or the resin component of a toner composition. The top layer E is also made porous.

FIG. 7 is a cross-sectional view of the image-receiving sheet to which a color toner image D is transferred by using the color copying apparatus as shown in FIG. 2. In the color toner image D, magenta toner particles (M), yellow toner particles (Y) and cyan toner particles (C) are accumulated in accordance with the color to be produced. In such a state as shown in FIG. 7, the light is irregularly reflected by the surfaces of the utmost toner layer and only the respective toner colors which are tinged with white are recognized, and the reproduced color by color mixture is never recognized even though the color toner particles are accumulated.

In FIG. 8, the transferred color toner image D is fixed on the image-receiving sheet in the image-fixing unit comprising a heat-application roller and a pressure-application roller in the conventional color copying apparatus as shown in FIG. 2. When the temperature is increased in the image-fixing unit, the resin contained in the porous overcoat layer B first starts to be fluidified and the pores and voids Ba and Bb are filled up. Subsequently, the top layer E starts to he fluidified and the toner particles on the minute gaps of the porous top layer E gradually permeate through the top layer E and the overcoat layer B by the action of capillarity. The color image D is deformed somewhat because heat and pressure are applied thereto, but the color image D is embedded in the overcoat layer B as almost retaining its original form. Thus, the toner particles constituting the color toner image D are uniformly incorporated into the overcoat layer B, so that the overcoat layer B becomes transparent with sufficient color light transmission properties, which overcoat layer B bears a color image area with excellent color reproduction.

Furthermore, an image-receiving sheet of the present invention may comprise a transparent support and an overcoat layer, formed thereon, which overcoat layer comprises a thermoplastic resin having a different viscoelasticity from that of a toner component or a resin contained in a toner composition used for image formation, and is white and opaque from being in a porous state.

According to the present invention, an electrophotographic method comprising the steps of transferring a toner image to the above-mentioned image-receiving sheet and fixing the toner image thereon by using a heat-application roller and/or a pressure-application roller can be provided.

The aforementioned type of image-receiving sheet can be prepared by coating a thermoplastic resin having a different viscoelasticity from that of the toner component or a resin contained in the toner composition used for image formation on at least one side of a support such as a transparent film or a sheet of paper. The viscoelasticity for use in the present invention is expressed by the loss tangent (tanδ) of the ratio of the loss elastic modulus (G″) to the storage elastic modulus (G′), which is obtained by the following formula:

$$\text{Loss tangent } (\tan\delta) = \frac{\text{Loss elastic modulus } (G'')}{\text{Storage elastic modulus } (G')}$$

Generally, the thermoplastic resin used for the toner has both the elasticity and the viscosity. In the case where the toner image comprising such a thermoplastic resin is caused to pass between the heat-application roller and the pressure-application roller, the toner image is once deformed because of the application thereto of the pressure energy. After the toner image has been caused to pass between the heat- and pressure-application rollers, the pressure is released, so that the toner image tends to return to the original form by the restoring force. When the thermoplastic resin for use in the toner has a high elasticity, the toner image can easily return to the original form because the relaxation time required to decrease the stress is long. On the other hand, when the elasticity of the thermoplastic resin for use in the toner is low, the relaxation time required to decrease the stress is short, so that the toner image is retained as being deformed by the heat- and pressure-application rollers.

The relaxation time required to decrease the stress applied to the thermoplastic resin is closely related to the above-mentioned loss tangent (tanδ), namely, the viscoelasticity of the thermoplastic resin. In addition, the glossiness of the obtained toner image is determined by the loss tangent (tanδ) of the thermoplastic resin for use in the toner.

Figure 9:
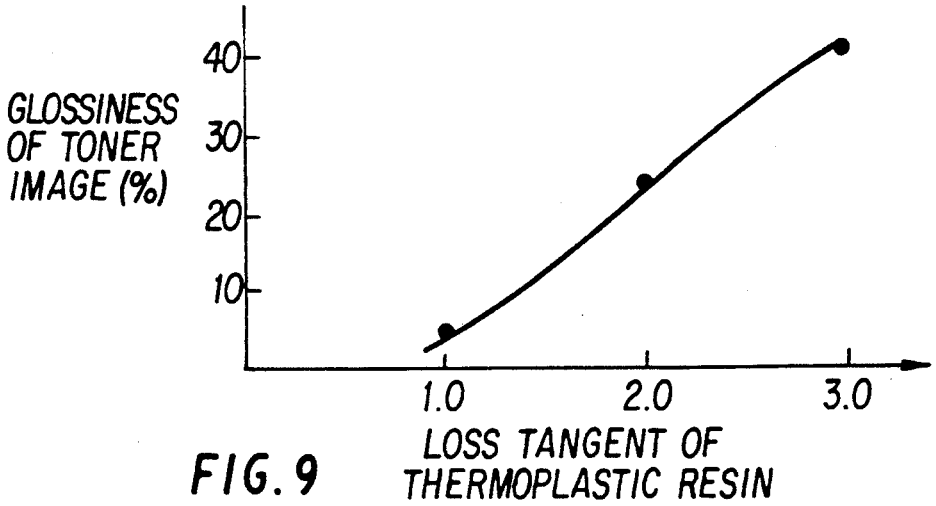
FIG. 9 is a graph showing the relationship between the loss tangent of a thermoplastic resin used for a toner and the glossiness of the obtained toner image.

FIG. 9 is a graph showing the relationship between the loss tangent (tanδ) of the thermoplastic resin for use in the toner and the glossiness of the image which is obtained under such image-fixing conditions as the applied pressure, the nip time (the time when the pressure is applied) and the temperature of the heat-application roller being controlled in accordance with the conventional heat- and pressure-application type image fixing method.

As is apparent from the graph shown in FIG. 9, the higher the loss tangent of the thermoplastic resin for use in the toner, the higher the glossiness of the obtained toner image. When the loss tangent of the thermoplastic resin for use in the toner is too high, however, the life of the employed developer is shortened. In the present invention, therefore, the overcoat layer of the image-receiving sheet comprises a thermoplastic resin, the loss tangent of which, closely related to the image quality such as the image glossiness, is higher than that of a toner component or a resin contained in a toner composition for image formation, with the entire system of image formation taken into consideration.

Examples of the thermoplastic resin for use in the above-mentioned overcoat layer include homopolymers and copolymers of styrene and styrene derivatives such as p-chlorostyrene and vinyltoluene; copolymers of styrene and acrylic esters, such as styrene - methyl acrylate copolymer, styrene - ethyl acrylate copolymer, styrene - n-butyl acrylate copolymer and styrene - hexyl acrylate copolymer; copolymers of styrene and methacrylic esters, such as styrene - methyl methacrylate copolymer, styrene - ethyl methacrylate copolymer, styrene - n-butyl methacrylate copolymer and styrene - hexyl methacrylate copolymer; copolymers of styrene, acrylic ester and methacrylic ester; copolymers of styrene and a vinyl monomer, such as styrene -acrylonitrile copolymer, styrene - butadiene copolymer, styrene - vinylmethyl ketone copolymer, styrene - maleic acid ester copolymer and styrene - acrylonitrile - indene copolymer; polymethyl methacrylate; polybutyl methacrylate; polyvinyl acetate; polyester; polyamide; epoxy resin; polyvinyl butyral; polyacrylic acid; phenolic resin; aliphatic hydrocarbon resin; alicyclic hydrocarbon resin; petroleum resin; low-molecular-weight polyethylene; copolymers of ethylene and acrylic esters; and saturated polyester copolymers. These resins can be used alone or in combination.

As previously mentioned, the image-receiving sheet according to the present invention comprises a support and a porous overcoat layer in a white and opaque state, formed thereon, which overcoat layer comprises a thermoplastic resin having a different viscoelasticity from that of a toner component or a resin contained in a toner composition. More specifically, the thermoplastic resin for use in the above-mentioned overcoat layer has a different loss tangent, namely, the ratio of the loss elastic modulus to the storage elastic modulus, from that of the toner component or the resin contained in the toner composition. It is preferable that the loss tangent of the thermoplastic resin for use in the overcoat layer be higher than that of the toner component or the resin contained in the toner composition, and more preferably higher by 0.5 or more.

To form on the support of the image-receiving sheet a porous overcoat layer in a state of being white and opaque, which comprises the aforementioned thermoplastic resin, a blowing agent is dispersed or dissolved in a resin solution prepared by dissolving the above-mentioned thermoplastic resins into an appropriate organic solvent such as dimethylformamide, methyl ethyl ketone or tetrahydrofuran, and the resultant resin solution may be coated on the support.

The blowing agent may be caused to expand under application of heat thereto in the course of the coating operation or after the coating operation. Alternatively, the above-mentioned resin solution without the blowing agent may be coated on the support and the support having a coated resin layer thereon may be dipped into a coagulation liquid such as water to carry out the wet-type coagulation. Subsequently, the coagulated resin layer on the support is dipped into hot water of 70° C. or more to extract a solvent from the coagulated resin solution. The method for making the surface of the overcoat layer porous is not limited to the above.

It is preferable that the thickness of that kind of overcoat layer of the image-receiving sheet be in the range of about 3 to 30 μm, and more preferably in the range of about 5 to 10 μm.

The electrophotographic method of the present invention comprises the steps of transferring a toner image to the above-mentioned image-receiving sheet comprising the support and the overcoat layer which comprises a thermoplastic resin having a different viscoelasticity from that of a toner component or a resin contained in a toner composition, and fixing the toner image on the image-receiving sheet. This electrophotographic method can be carried out in the conventional color copying apparatus as shown in FIG. 2.

Figure 10:
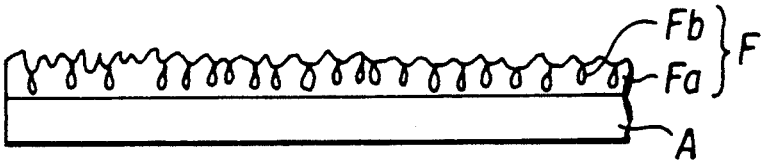
FIGS. 10 to 12 are schematic cross-sectional views of a further embodiment of the image-receiving sheet of the present invention, in explanation of the process of transferring and image-fixing of color toner particles to the image-receiving sheet.
Figure 11:
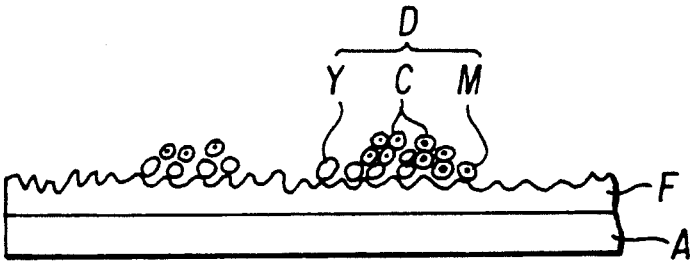
Figure 12:
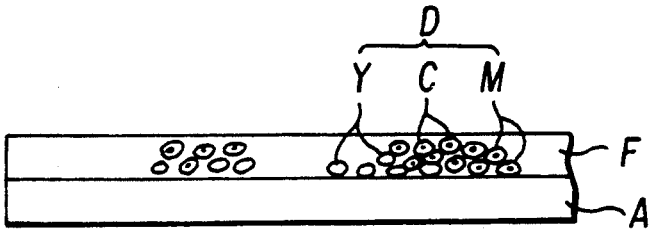

FIGS. 10 to 12 show the image-transferring and image-fixing processes of a toner image in the case where the image-receiving sheet according to the present invention comprising a support A and a porous overcoat layer F is used. In FIG. 10, the porous overcoat layer F, which is in a white and opaque state, and has minute pores, apertures and voids Fa and Fb on the surface, comprises a thermoplastic resin whose loss tangent is higher than that of a toner component or a resin contained in a toner composition.

FIG. 11 is a cross-sectional view of the image-receiving sheet to which a color toner image D is transferred by using the color copying apparatus as shown in FIG. 2. In the color toner image D, magenta toner particles (M), yellow toner particles (Y) and cyan toner particles (C) are accumulated in accordance with the color to be produced. In such a state as shown in FIG. 11, the light is irregularly reflected by the surfaces of the utmost toner layer and only the respective toner colors which are tinged with white are recognized, and the reproduced color by color mixture is never recognized even though the color toner particles are accumulated.

In FIG. 12, the transferred color toner image D is fixed on the image-receiving sheet in the image-fixing unit comprising a heat-application roller and a pressure-application roller in the conventional color copying apparatus as shown in FIG. 2. When the temperature is increased in the image-fixing unit, the thermoplastic resin contained in the porous overcoat layer F first starts to be fluidified and the pores and voids Fa and Fb are filled up. At the same time, the toner particles on the minute gaps of the porous overcoat layer F gradually permeate through the overcoat layer F by the action of capillarity. The color image D is deformed somewhat because heat and pressure are applied thereto, but the color image D is embedded in the overcoat layer F as almost retaining its original form. Thus, the toner particles constituting the color toner image D are uniformly incorporated into the overcoat layer F, so that the overcoat layer F becomes transparent with sufficient color light transmission properties, which overcoat layer F bears a color image area with excellent color reproduction.

According to the present invention, there can be provided an image-receiving sheet comprising a support; an overcoat layer formed on the support, the overcoat layer comprising a thermoplastic resin which has a fluidification initiation temperature lower than that of a toner for image formation to be employed or that of a resin contained in the toner; and a top layer on the overcoat layer, which comprises a thermoplastic resin with an abrasion resistance higher than the abrasion resistance of the overcoat layer, and has a fluidification initiation temperature which is higher than that of the resin in the overcoat layer and the same as or lower than that of the toner or that of the resin contained in the toner, and this image-receiving sheet can also be employed in the electrophotographic method of the present invention.

Furthermore, according to the present invention, there can be provided an image-receiving sheet comprising a transparent support and an overcoat layer formed on the transparent support, the overcoat layer (i) comprising a thermoplastic resin having a viscoelasticity different from that of a toner to be used for image formation or that of a resin contained in the toner, and (ii) being white and opaque from being in a porous state, and this image-receiving sheet can also be employed in the electrophotographic method of the present invention.

Other features of this invention will become apparent in the course of the following description of exemplary embodiments, which are given for illustration of the invention and are not intended to be limiting thereof.

EXAMPLE 1

100 parts by weight of a saturated polyester copolymer resin with a fluidification initiation temperature of 68° C. was dissolved in 326 parts by weight of dimethylformamide, so that a coating liquid for an overcoat layer was prepared.

The thus prepared coating liquid for an overcoat layer was coated on a transparent polyester film with a thickness of 100 μm, serving as a support, in a thickness of about 5 μm. The polyester film having a coated resin layer thereon was dipped into water of 20° C. for one minute to carry out the wet-type coagulation. Subsequently, the polyester film with the resin layer was then dipped into hot water of 70° C. for 5 seconds to extract the solvent component from the coagulated resin solution. Thus, a porous overcoat layer was formed on the support, whereby an image-receiving sheet (OHP film) according to the present invention, for use with the color electrophotographic method was obtained.

Using the above-prepared image-receiving sheet according to the present invention and the color copying apparatus as shown in FIG. 2, a color copying test was conducted by subjecting a color patch to the copying operation at the image-fixing temperature of 160° C.

EXAMPLE 2

The procedure for preparation of the image-receiving sheet (OHP film) in Example 1 was repeated except that the dimethylformamide solution of the saturated polyester copolymer resin employed in Example 1 was coated on the same transparent polyester film as in Example 1 in a thickness of about 10 μm. Thus, an image-receiving sheet (OHP film) according to the present invention, for use with the color electrophotographic method was obtained.

Using the above-prepared image-receiving sheet according to the present invention and the color copying apparatus as shown in FIG. 2, a color copying test was conducted by subjecting a color patch to the copying operation at the image-fixing temperature of 160° C.

COMPARATIVE EXAMPLE 1

A conventional transparent polyester film with a thickness of 100 μm was prepared as an OHP film for the color electrophotographic method.

Using the above-prepared comparative OHP film and the color copying apparatus as shown in FIG. 2, a color copying test was conducted by subjecting a color patch to the copying operation at the image-fixing temperature of 160° C.

As the result of the color copying test, the following items were evaluated.

(1) Sharpness of Character Image

A black character image was formed on each image-receiving sheet by overlapping three primary color toner particles, that is, magenta, cyan and yellow toner particles, and the sharpness of the black character image was visually inspected.

(2) Color Reproduction

An average value was obtained from the color difference of seven colors of the color patches measured by a commercially available color difference meter, "Sigma 80" (Trademark), made by Nippon Denshoku Kogyo Co., Ltd.

(3) Color Light Transmission Properties

Using an over-head projector, light was applied to each image-receiving sheet carrying color images. The projected image was visually inspected in comparison with the projected image of a color image obtained by the silver salt reprography.

(4) Glossiness

The glossiness of the image was expressed by the reflectance at an angle of 60° measured by a commercially available variable glossmeter "VD-ID" (Trademark), made by Nippon Denshoku Kogyo Co., Ltd.

The results of the evaluation are given in Table 1.

TABLE 1

| Example No. | Sharpness of Character Image | Color Reproduction | Color Light Transmission Properties | Glossiness (%) |
|---|---|---|---|---|
| Ex. 1 | ○ | 10.3 | ○ | 30.3 |
| Ex. 2 | ○ | 8.6 | ○ | 35.7 |
| Comp. Ex. 1 | ○ (*) | 30.2 (**) | x (***) | 17.8 |

(*) Although the sharpness of the character image was good, the image-fixing properties were poor.
(**) The image-fixing properties were poor.
(***) Each color of the obtained image became dull. The color light transmission properties were not observed.

As can be seen from the results in Table 1, the image-receiving sheets according to the present invention, obtained in Examples 1 and 2 were superior over the comparative image-receiving sheet obtained in Comparative Example 1 in the sharpness of the image, the color reproduction, the color light transmission properties and the glossiness of the obtained image. In addition, such satisfactory results were obtained even when a toner with a low softening point was not especially employed and the image-fixing temperature was not excessively increased.

In the case of the black and white electrophotographic method, the satisfactory results can be obtained when the image-receiving sheets according to the present invention are used.

EXAMPLE 3

100 parts by weight of a saturated polyester copolymer resin with a fluidification initiation temperature of 68° C. and a molecular weight of about 50,000 was dissolved in 326 parts by weight of dimethylformamide, so that a coating liquid for an overcoat layer was prepared.

The thus prepared coating liquid for an overcoat layer was coated on a transparent polyester film with a thickness of 100 μm, serving as a support, in a thickness of about 20 μm. The polyester film having a coated resin layer thereon was dipped into water of 20° C. for one minute to carry out the wet-type coagulation. Subsequently, the polyester film with the resin layer was then dipped into hot water of 70° C. for about 5 seconds to extract the solvent component from the coagulated resin solution. Thus, a porous overcoat layer was formed on the support.

50 parts by weight of a saturated polyester copolymer resin with a fluidification initiation temperature of 100° C. and a molecular weight of about 100,000 was dissolved in 300 parts by weight of dimethylformamide, so that a coating liquid for a top layer was prepared.

The thus prepared coating liquid for a top layer was spray-coated on the above-prepared overcoat layer in a thickness of 2 μm, that is, 0.2 times the particle diameter (10 μm) of a toner to be employed, so that a top layer was formed on the overcoat layer. Thus, an image-receiving sheet (OHP film) according to the present invention, for use with the color electrophotographic method was obtained.

Using 100 sheets of the above-prepared image-receiving sheet according to the present invention and the color copying apparatus as shown in FIG. 2, a running test was conducted at the image-fixing temperature of 160° C.

EXAMPLE 4

The procedure for preparation of the image-receiving sheet (OHP film) in Example 3 was repeated except that the same coating liquid for a top layer as used in Example 3 was spray-coated on the same overcoat layer as in Example 3 in a thickness of 10 μm. Thus, an image-receiving sheet (OHP film) according to the present invention, for use with the color electrophotographic method was obtained.

Using 100 sheets of the above-prepared image-receiving sheet according to the present invention and the color copying apparatus as shown in FIG. 2, a running test was conducted at the image-fixing temperature of 160° C.

COMPARATIVE EXAMPLE 2

The procedure for preparation of the image-receiving sheet (OHP film) in Example 3 was repeated except that the same coating liquid for a top layer as used in Example 3 was spray-coated on the same overcoat layer as in Example 3 in a thickness of 20 μm, which exceeded the particle diameter (about 10 μm) of the employed toner. Thus, a comparative image-receiving sheet (OHP film), for use with the color electrophotographic method was obtained.

Using 100 sheets of the above-prepared comparative image-receiving sheet and the color copying apparatus as shown in FIG. 2, a running test was conducted at the image-fixing temperature of 160° C.

EXAMPLE 5

100 parts by weight of a saturated polyester copolymer resin with a fluidification initiation temperature of 68° C. was dissolved in 326 parts by weight of dimethylformamide, so that a coating liquid for an overcoat layer was prepared.

The thus prepared coating liquid for an overcoat layer was coated on a transparent polyester film with a thickness of 100 μm, serving as a support, in a thickness of about 20 m. The polyester film having a coated resin layer thereon was dipped into water of 20° C. for one minute to carry out the wet-type coagulation. Subsequently, the polyester film with the resin layer was then dipped into hot water of 70° C. for about 5 seconds to extract the solvent component from the coagulated resin solution. Thus, a porous overcoat layer was formed on the support.

50 parts by weight of a styrene - methyl methacrylate copolymer with a fluidification initiation temperature of 95° C. was dissolved in 350 parts by weight of toluene, so that a coating liquid for a top layer was prepared.

The thus prepared coating liquid for a top layer was spray-coated on the above-prepared overcoat layer in a thickness of 5 μm.

The Taber abrasion index of the saturated polyester copolymer resin for use in the overcoat layer and that of the styrene - methyl methacrylate copolymer for use in the top layer were 58 mg and 21 mg, respectively, when measured by a Taber abrader. In other words, the styrene - methyl methacrylate copolymer for use in the top layer was superior in the abrasion resistance.

Thus, an image-receiving sheet (OHP film) according to the present invention, for use with the color electrophotographic method was obtained.

Using 100 sheets of the above-prepared image-receiving sheet according to the present invention and the color copying apparatus as shown in FIG. 2, a running test was conducted at the image-fixing temperature of 160° C.

COMPARATIVE EXAMPLE 3

100 parts by weight of a saturated polyester copolymer resin with a fluidification initiation temperature of 68° C. was dissolved in 326 parts by weight of dimethylformamide, so that a coating liquid for an overcoat layer was prepared.

The thus prepared coating liquid for an overcoat layer was coated on a transparent polyester film with a thickness of 100 μm, serving as a support, in a thickness of about 20 μm. The polyester film having a coated resin layer thereon was dipped into water of 20° C. for one minute to carry out the wet-type coagulation. Subsequently, the polyester film with the resin layer was then dipped into hot water of 70° C. for about 5 seconds to extract the solvent component from the coagulated resin solution. Thus, a porous overcoat layer was formed on the support.

50 parts by weight of a styrene - methyl methacrylate copolymer with a fluidification initiation temperature of 95° C. was dissolved in 350 parts by weight of toluene, so that a coating liquid for a top layer was prepared.

The thus prepared coating liquid for a top layer was spray-coated on the above-prepared overcoat layer in a thickness of about 20 μm, which exceeded the particle diameter of a toner to be employed.

Thus, a comparative image-receiving sheet (OHP film), for use with the color electrophotographic method was obtained.

Using 100 sheets of the above-prepared comparative image-receiving sheet and a commercially available copying apparatus "Artage 5330" (Trademark) made by Ricoh Company, Ltd., a running test was conducted at the image-fixing temperature of 175° C. and the nip width of 7.5±0.5 mm.

The fluidification initiation temperature of each of the employed color toners used in any running test was 107°±5° C.

As the result of the running test, the following items were evaluated.

(1) Color Light Transmission Properties

Using an over head projector, the light was applied to each image-receiving sheet carrying color images. The projected image was visually inspected, when compared with the projected image of a color image obtained by the silver salt diffusion transfer process.

(2) Toner Deposition on Background of the Image-Receiving Sheet

After 100 sheets of each image-receiving sheet were subjected to the running test, copy was made on a sheet of the image-receiving sheet with the copy density controlled to the maximum value. The toner deposition on the background of the image-receiving sheet was visually inspected.

The results of the evaluation are given in Table 2.

TABLE 2

| Example No. | Color Light Transmission Properties | Toner Deposition on Background (Filming Problem) |
|---|---|---|
| Ex. 3 | ○ | absent |
| Ex. 4 | ○ | absent |
| Ex. 5 | ○ | absent |
| Comp. Ex. 2 | x (*) | absent |
| Comp. Ex. 3 | x (*) | absent |

(*) Each color of the obtained image became dull. The color light transmission properties were not observed.

The image-receiving sheets according to the present invention, obtained in Examples 3 to 5 were opaque before they were subjected to the image-fixing operation. After the image-fixing operation, the porous surface was made uniform by the application of heat and pressure thereto and the image-receiving sheets assumed a transparent state.

As can be seen from the results in Table 2, the image-receiving sheets of the present invention are superior in the color light transmission properties and durability, and capable of yielding copy images without the toner deposition on the background. On the other hand, when the thickness of the top layer of the image-receiving sheet exceeds the particle diameter of the employed toner as shown in Comparative Examples 2 and 3, the image-receiving sheet is not made transparent after the image-fixing operation, so that the color light transmission properties cannot be improved.

EXAMPLE 6

100 parts by weight of a saturated polyester copolymer resin with a loss tangent of 2.8 at 160° C. was dissolved in 300 parts by weight of dimethylformamide, so that a coating liquid for an overcoat layer was prepared.

The thus prepared coating liquid for an overcoat layer was coated on a transparent polyester film with a thickness of 100 μm, serving as a support, in a thickness of about 5 μm. The polyester film having a coated resin layer thereon was dipped into water of 20° C. for one minute to carry out the wet-type coagulation. Subsequently, the polyester film with the resin layer was then dipped into hot water of 70° C. for 5 seconds to extract the solvent component from the coagulated resin solution. Thus, a porous overcoat layer was formed on the support, whereby an image-receiving sheet (OHP film) according to the present invention, for use with the color electrophotographic method was obtained.

Using the above-prepared image-receiving sheet according to the present invention and a commercially available color copying apparatus "Artage 5330" (Trademark), made by Ricoh Company, Ltd, as shown in FIG. 2, a color copying test was conducted by subjecting a color patch to the copying operation.

EXAMPLE 7

The procedure for preparation of the image-receiving sheet (OHP film) in Example 6 was repeated except that the dimethylformamide solution of the saturated polyester copolymer resin employed in Example 6 was coated on the same transparent polyester film as in Example 6 in a thickness of about 10 μm. Thus, an image-receiving sheet (OHP film) according to the present invention, for use with the color electrophotographic method was obtained.

Using the above-prepared image-receiving sheet according to the present invention and a commercially available color copying apparatus "Artage 5330" (Trademark), made by Ricoh Company, Ltd, as shown in FIG. 2, a color copying test was conducted by subjecting a color patch to the copying operation.

EXAMPLE 8

100 parts by weight of a styrene - acrylate copolymer (8.5/1.5) with a loss tangent of 3.0 at 160° C. was dissolved in 300 parts by weight of a mixed solvent consisting of dimethylformamide and tetrahydrofuran (1:1 ratio by weight), so that a coating liquid for an overcoat layer was prepared.

The thus prepared coating liquid for an overcoat layer was coated on a transparent polyester film with a thickness of 100 μm, serving as a support, in a thickness of about 5 μm. The polyester film having a coated resin layer thereon was dipped into water of 20° C. for one minute to carry out the wet-type coagulation. Subsequently, the polyester film with the resin layer was then dipped into hot water of 70° C. for 3 seconds to extract the solvent component from the coagulated resin solution. Thus, a porous overcoat layer was formed on the support, whereby an image-receiving sheet (OHP film) according to the present invention, for use with the color electrophotographic method was obtained.

Using the above-prepared image-receiving sheet according to the present invention and a commercially available color copying apparatus "Artage 5330" (Trademark), made by Ricoh Company, Ltd, as shown in FIG. 2, a color copying test was conducted by subjecting a color patch to the copying operation.

EXAMPLE 9

The procedure for preparation of the image-receiving sheet (OHP film) in Example 8 was repeated except that the mixed solution of dimethylformamide and tetrahydrofuran of the styrene - acrylate copolymer employed in Example 8 was coated on the same transparent polyester film as in Example 8 in a thickness of about 10 μm. Thus, an image-receiving sheet (OHP film) according to the present invention, for use with the color electrophotographic method was obtained.

Using the above-prepared image-receiving sheet according to the present invention and a commercially available color copying apparatus "Artage 5330" (Trademark), made by Ricoh Company, Ltd, as shown in FIG. 2, a color copying test was conducted by subjecting a color patch to the copying operation.

COMPARATIVE EXAMPLE 4

The procedure for preparation of the image-receiving sheet (OHP film) in Example 8 was repeated except that the styrene - acrylate copolymer (8.5/1.5) with a loss tangent of 3.0 at 160° C. used for the overcoat layer in Example 8 was replaced by a styrene - n-butyl methacrylate copolymer (7/3) with a loss tangent of 2.0 at 160° C., so that a comparative image-receiving sheet was prepared.

Using the above-prepared comparative image-receiving sheet and a commercially available color copying apparatus "Artage 5330" (Trademark), made by Ricoh Company, Ltd, as shown in FIG. 2, a color copying test was conducted by subjecting a color patch to the copying operation.

The loss tangent of each color toner used in the color copying test was 2.5±0.1 at 160° C. and 3.0±0.1 at 170° C. In this test, the image-fixing temperature was controlled to 160° C., which was lower than the usual temperature by 10° C.

As the result of the color copying test, the following items were evaluated in the same manner as in the above.

The results of the evaluation are given in Table 3.

TABLE 3

| Example No. | Sharpness of Character Image | Color Reproduction | Color Light Transmission Properties | Glossiness (%) |
|---|---|---|---|---|
| Ex. 8 | ○ | 11.8 | ○ | 32.4 |
| Ex. 9 | ○ | 9.0 | ○ | 33.1 |
| Ex. 10 | ○ | 10.5 | ○ | 28.5 |
| Ex. 11 | ○ | 8.3 | ○ | 29.6 |
| Comp. Ex. 4 | ○ (*) | 29.7 | x | 19.0 |

(*) Although the sharpness of the character image was good, the image-fixing properties were poor.

As can be seen from the results in Table 3, the image-receiving sheets according to the present invention, obtained in Examples 8 to 11 were superior over the comparative image-receiving sheet obtained in Comparative Example 4 in the sharpness of the image, the color reproduction, the color light transmission properties and the glossiness of the obtained image. In addition, such satisfactory results were obtained even when a toner with a low softening point was not especially employed and the image-fixing temperature was not excessively increased.

As previously mentioned, toner images with high quality and high transmission properties can be reproduced on the image-receiving sheet according to the present invention. In addition, according to the electrophotographic method of the present invention, in particular, to the color electrophotographic method using the above-mentioned image-receiving sheet, the image-fixing operation can be performed at a relatively low temperature, so that various problems caused by the image-fixing operation at high temperatures can be solved.

Furthermore, the image-receiving sheet of the present invention, which comprises a support, an overcoat and a top layer, is remarkably advantageous from the industrial viewpoint because abrasion caused by the friction of paper transporting rollers can be minimized.

We claim:

1. An image-receiving sheet for use in an electrophotographic method comprising a transparent support and an overcoat layer formed thereon, said overcoat layer (i) comprising a thermoplastic resin which has a fluidification initiation temperature lower than of a toner for image formation to be employed or that of a resin contained in said toner, and (ii) being white and opaque from being in a porous state, wherein said overcoat layer is capable of turning transparent when heated to said fluidification temperature.

2. The image-receiving sheet as claimed in claim 1, further comprising a top layer on said overcoat layer, which comprises a thermoplastic resin with an abrasion resistance higher than the abrasion resistance of said overcoat layer, having a fluidification initiation temperature which is higher than that of said resin in said overcoat layer and the same as or lower than that of said toner or that of said resin contained in said toner.

3. The image-receiving sheet as claimed in claim 2, wherein said top layer is capable of turning transparent when heated to said fluidification temperature thereof.

4. The image-receiving sheet as claimed in claim 1, wherein said fluidification initiation temperature of said thermoplastic resin for use in said overcoat layer is lower than that of said resin contained in said toner by 5° C. or more when measured by a flow tester.

5. The image-receiving sheet as claimed in claim 1, wherein said overcoat layer has a thickness ranging from 3 to 30 μm.

6. The image-receiving sheet as claimed in claim 1, wherein said thermoplastic resin for use in said overcoat layer is selected from the group consisting of homopolymers and copolymers of styrene and styrene derivatives; copolymers of styrene and acrylic esters; copolymers of styrene and methacrylic esters; copolymers of styrene, acrylic esters and methacrylic esters; copolymers of styrene and vinyl monomers; polymethyl methacrylate; polybutyl methacrylate; polyvinyl acetate; polyester; polyamide; epoxy resin; polyvinyl butyral; polyacrylic acid; phenolic resin; aliphatic hydrocarbon resin; alicyclic hydrocarbon resin; petroleum resin; low-molecular-weight polyethylene; copolymers of ethylene and acrylic esters; and saturated polyester copolymers.

7. The image-receiving sheet as claimed in claim 1, wherein said top layer has a thickness ranging from 3 to 30 μm.

8. The image-receiving sheet as claimed in claim 1, wherein said top layer has a thickness which is 0.2 to 1 times the particle diameter of said toner.

9. An image-receiving sheet for use in an electrophotographic method comprising:

a support;

an overcoat layer formed on said support, said overcoat layer comprising a thermoplastic resin which has a fluidification initiation temperature lower than that of a toner for image formation to be employed or that of a resin for use in said toner and capable of turning transparent when heated to the fluidification temperature; and a top layer on said overcoat layer, which comprises a thermoplastic resin with an abrasion resistance higher than the abrasion resistance of said overcoat layer, and has a fluidification initiation temperature which is higher than that of said resin in said overcoat layer and the same as or lower than that of said toner or that of said resin contained in said toner.

10. An image-receiving sheet for use in an electrophotographic method comprising a transparent support and an overcoat layer formed on said transparent support, said overcoat layer (i) comprising a thermoplastic resin having a different viscoelasticity from that of a toner to be used for image formation or a resin for use in said toner, and (ii) being white and opaque from being in a porous state, wherein said overcoat layer is capable of turning transparent when heated to said fluidification temperature.

11. The image-receiving sheet as claimed in claim 10, wherein said thermoplastic resin for use in said overcoat layer has a viscoelasticity expressed by the loss tangent ($\tan\delta$) of the ratio of the loss elastic modulus ($G''$) to the storage elastic modulus ($G'$), which is greater than that of said toner or said resin contained in said toner.

12. The image-receiving sheet as claimed in claim 11, wherein the loss tangent of said thermoplastic resin for use in said overcoat layer is greater than that of said toner or said resin contained in said toner by 0.5 or more.

13. The image-receiving sheet as claimed in claim 10, wherein said overcoat layer has a thickness ranging from 3 to 30 $\mu$m.

* * * * *

UNITED STATES PATENT AND TRADEMARK OFFICE

CERTIFICATE OF CORRECTION

PATENT NO. : 5,208,211

DATED : May 4, 1993

INVENTOR(S) : Tsuneo Kurotori, et al.

It is certified that error appears in the above-indentified patent and that said Letters Patent is hereby corrected as shown below:

Column 9, line 64 "he fluidified" should read --be fluidified--

Column 16, line 17 "20 m." should read --20 μm.--

Signed and Sealed this

Eleventh Day of October, 1994

*Attest:*

*Attesting Officer*

BRUCE LEHMAN

*Commissioner of Patents and Trademarks*